United States Patent [19]

Kaupert

[11] 3,982,655

[45] Sept. 28, 1976

[54] NESTABLE COMPARTMENTALIZED TRAYS

[76] Inventor: Günther Kaupert, Thuringer Str. 1, D-5927 Erndtebruck, Westphalia, Germany

[22] Filed: Apr. 4, 1975

[21] Appl. No.: 565,215

Related U.S. Application Data

[62] Division of Ser. No. 385,240, Aug. 3, 1973, Pat. No. 3,884,381.

[30] Foreign Application Priority Data

Aug. 4, 1972 Germany ..... 2238393

[52] U.S. Cl. ..... 220/23.6; 206/514; 206/518; 206/519; 220/23.8; 229/2.5 R

[51] Int. Cl.[2] ..... B65D 21/02; B65D 1/34

[58] Field of Search ..... 220/23.4, 23.6, 23.8; 229/2.5; 206/519, 515, 514, 518

[56] References Cited

UNITED STATES PATENTS

| | | | |
|---|---|---|---|
| 3,120,901 | 2/1964 | Boyd | 229/2.5 |
| 3,203,573 | 4/1965 | Rowe | 220/238 |
| 3,386,608 | 6/1968 | Diller | 220/23.6 |
| 3,485,434 | 12/1969 | Donovan | 229/2.5 |
| 3,502,241 | 3/1970 | Smith | 220/23.6 |

*Primary Examiner*—George E. Lowrance
*Attorney, Agent, or Firm*—Spencer & Kaye

[57] ABSTRACT

In nestable compartmentalized trays at least one portion of at least one connecting edge (formed by the converging, adjacent side walls of two side-by-side situated cup-shaped depressions constituting the compartments) is at a height from the base of the compartments that is different from the height of any other portion of the remaining connecting edges. When the trays are nested to form a stack, the abutting portions of the connecting edges of two adjoining nested trays have different heights from their associated bases. In this manner, the side walls of mutually nesting compartments are maintained spaced from one another.

2 Claims, 4 Drawing Figures

NESTABLE COMPARTMENTALIZED TRAYS

CROSS-REFERENCE TO RELATED APPLICATION

This application is a division of copending application Ser. No. 385,240, filed Aug. 3, 1973, now U.S. Pat. No. 3,884,381.

BACKGROUND OF THE INVENTION

This invention relates to nestable compartmentalized trays made of a thin sheet material and having a plurality of downwardly narrowing cup-shaped depressions. Two side-by-side extending side walls, one belonging to one depression and the other belonging to an adjoining depression, converge upwardly and terminate in a common upper connecting edge. Trays of this structure may be nested in one another to form a tray stack.

Compartmentalized trays of the aforenoted type are often made of a stampable shape-retaining sheet made of a synthetic material which may be metallized. Trays of this type serve, in package making, for receiving goods, such as chocolate candies, cookies, mechanical parts, pharmaceutical products, etc., and are shipped to the manufacturer generally in stacks. As a first step, the stacked, nested compartmentalized trays, before charging them with goods, have to be separated ("denested") which may be performed by a special apparatus such as described, for example, in German Patent No. 1,586,152 or U.S. Pat. No. 3,401,831. In such operation the force which sometimes develops and with which the nested trays "stick" together, presents certain difficulties in that it resists separation. Such forces generally appear between the engaging sloping side walls of the depressions of two immediately superposed, nested trays.

In order to prevent the appearance of such forces which hinder the separation of the nested compartmentalized trays, it has already been proposed to provide, at preselected locations of the trays, for example along their edges, spacer members such as lugs or bosses which form an integral part of the tray and which are staggered with respect to one another from tray to tray within the stack. This mode of insuring appropriate distances between trays, however, is not always a satisfactory solution. Thus, for example, in packages which are destined to reach directly a final consumer, the external appearance has a significant role. Thus, features like the aforenoted integral spacer members may be considered as aesthetically disturbing and hence undesirable, even though, from a purely technological point of view, they may be considered as advantageous.

SUMMARY OF THE INVENTION

It is an object of the invention to provide improved nestable compartmentalized trays of the above-outlined type from which the discussed disadvantage is eliminated and yet an easy separation of the nested trays is ensured.

This object and others to become apparent as the specification progresses are accomplished by the invention according to which, briefly stated, in each tray at least one portion of at least one connecting edge is at a height from the base (or lowermost wall portion) of the compartments that is different from the height of any other portion of the remaining connecting edges in the same tray. When the trays are nested, the abutting portions of the connecting edges of two adjoining nested trays have different heights from their associated bases. In this manner, it is ensured that the side walls of mutually nesting compartments are maintained spaced from one another.

Advantageously, each individual compartmentalized tray has at least two upper edges that are at a different (preferably lower) height than the other connecting edges of the same tray. Such lowered connecting edges of the same tray may be, for example, diagonally opposed. The stacking of the trays is then performed in such a manner that the thus defined diagonals cross each other from tray to tray.

According to the invention there is accomplished a resilient spacing of the nested compartmentalized trays (that is, the mutually nesting side walls are urged to be maintained spaced) for facilitating their separation without providing on the individual trays visible spacer means and also, without adversely affecting the primary function of the trays which is the orderly accommodation of goods.

DESCRIPTION OF THE PREFERRED EMBODIMENTS

Figure 1:
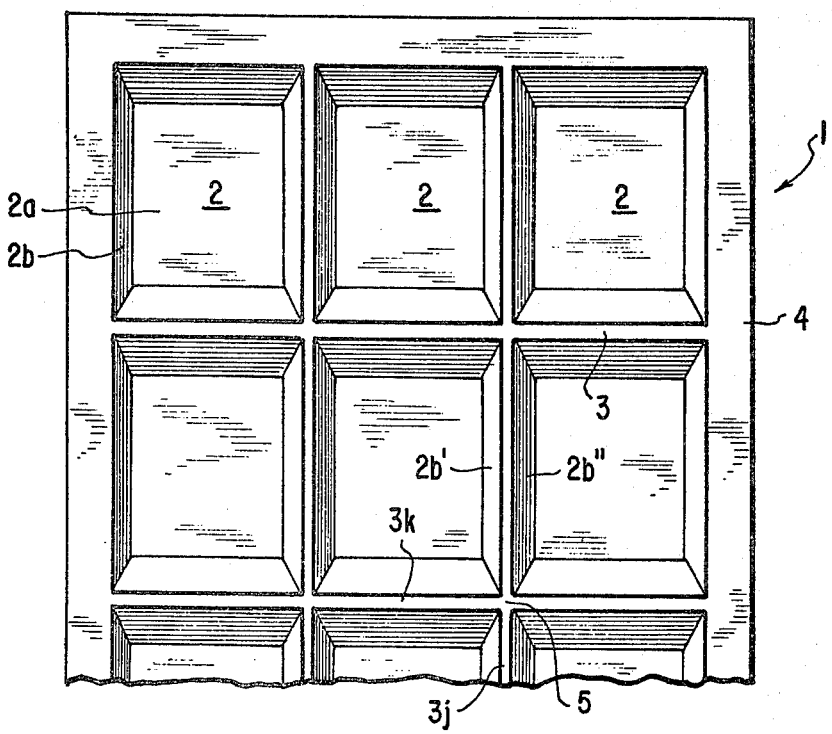
FIG. 1 is a plan view of a compartmentalized tray incorporating the invention.

Turning first to FIG. 1, there is shown a compartmentalized tray generally indicated at 1 which is made of a thin sheet material and which has cup-shaped depressions 2 each having a base 2*a* and side walls 2*b* sloping inwardly towards the base 2*a*. Two side-by-side extending side walls, such as 2*b'* and 2*b''*, one belonging to one depression and the other belonging to an adjoining depression, converge upwardly (viewed in the normal upright position of the tray) and terminate in a common upper connecting edge 3, defining the common border of two adjoining depressions 2.

The entire tray is bounded by a marginal peripheral edge face 4.

Figure 2:
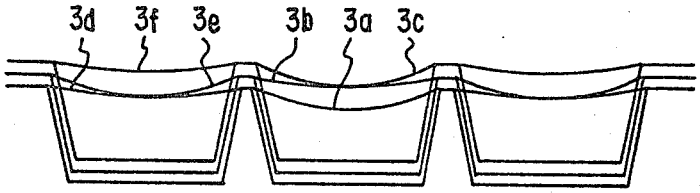
FIG. 2 is a schematic sectional side elevational view of a number of nested trays according to a preferred embodiment of the invention.

Turning now to the embodiment illustrated in FIG. 2, it is seen that each connecting edge 3*a*, 3*b*, 3*c*, 3*d*, 3*e* and 3*f* is downwardly arcuate (that is, it is arcuate towards the base of the depressions). Further, each tray has at least one connecting edge, such as 3*a*, which has a lesser radius of curvature than other connecting edges such as 3*d*. This means that those connecting edges that have the lesser radius of curvature, have a lowest point which is situated at a lesser height (vertical distance) from the base 2*a* than the lowest point on the other connecting edges that have a greater radius of curvature. If now, as illustrated in FIG. 2, the trays are stacked in such a manner according to the invention that a connectng edge 3*e* of relatively small radius of curvature is positioned immediately above a connecting edge 3*d* of relatively large radius of curvature, then the lowest points on connecting edges 3*e* and 3*d* will be in contact while the side walls of the identically shaped depressions of the two immediately nesting trays are kept out of contact.

The trays according to the embodiment in FIG. 2 are so designed that in each tray connecting edges of large radius of curvature altenate with connecting edges of small radius of curvature. Thus, in the uppermost tray of the stack shown in FIG. 2, the connecting edge 3*f* of large radius of curvature is adjoined by the connecting edge 3*c* of small radius of curvature. A similar arrangement may be observed in the middle tray regarding the edges 3*b* and 3*e* and in the lowermost tray regarding the edges 3*d* and 3*a*.

It is noted that the differently curved connecting edges in each tray according to FIG. 2 may be considered as aesthetically pleasing.

Figure 3:
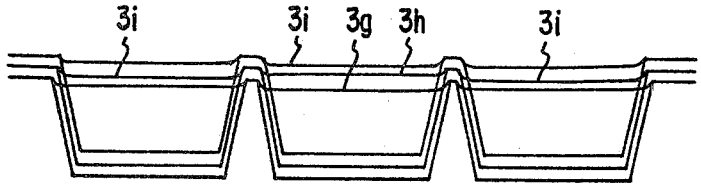
FIG. 3 is a schematic sectional side elevational view of a plurality of nested trays in accordance with another preferred embodiment of the invention.

The same spacing effect discussed in connection with the embodiment shown in FIG. 2 may be achieved with straight, rather than arcuate connecting edges, as illustrated in the embodiment according to FIG. 3. Thus, the height of the connecting edges 3*g* and 3*i* from the base of their associated depressions is less than the height of the connecting edge 3*h* from the base of its associated depression. Stated differently, the connecting edges of smaller radius of curvature according to FIG. 2 are replaced in the embodiment according to FIG. 3 by straight edges of reduced height. When now the trays are nested to form a stack, connecting edges of two immediately adjacent nested trays will abut one another. The abutting connecting edges are at different heights from the base of their associated cup-shaped depressions.

Figure 4:
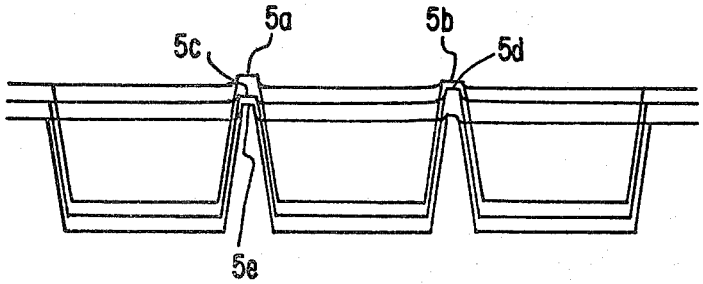
FIG. 4 is a schematic sectional side elevational view of a plurality of nested trays in accordance with a third preferred embodiment of the invention.

Turning once again to FIG. 1, according to a third embodiment of the invention, the location 5 of the intersection between two connecting edges, such as 3*j* and 3*k* is at a different height from the depression base than the otherwise uniform height level of the connecting edges in the same tray. It is preferred that at least two such positions be present in the same tray. Or, the tray may be so designed that the height of the locations 5 varies from intersection to intersection. Viewing trays designed according to the third embodiment in a nested condition as illustrated in FIG. 4, any location 5*a*, 5*b* in one tray has a height position that is different from that of a vertically immediately adjacent intersection 5*c*, 5*d* of two connecting edges. In this manner, the nested trays are in engagement with one another at the intersections 5*b*, 5*d* and 5*c*, 5*e* respectively, having, in the different trays, different height positions and thus a spacing between the side walls of the nesting cup-shaped depressions is ensured.

It will be understood that the above description of the present invention is susceptible to various modifications, changes and adaptations, and the same are intended to be comprehended within the meaning and range of equivalents of the appended claims.

I claim:

1. A stack constituted by a plurality of nested compartmentalized trays each having a plurality of cup-shaped depressions; each depression having a base and side walls sloping inwardly towards the base; two side-by-side extending side walls of two adjoining depressions in the same tray being convergent in a direction away from the bases and terminating in a common, straight connecting edge, whereby each tray has a plurality of straight connecting edges; the improvement wherein at least one straight connecting edge in each tray of the stack has a height distance from the base of the associated depressions that is different from the height distance of the remaining straight connecting edges in the same tray; said at least one straight connecting edge in each tray abutting a straight connecting edge of an immediately adjoining nested tray, the abutting straight connecting edges of the two immediately adjoining nested trays being at different heights from the base of their respective depressions, whereby the side walls of mutually nesting depressions are urged to be maintained spaced from one another.

2. A nestable compartmentalized tray as defined in claim 1, wherein said at least one straight connecting edge has a height distance from the base of the associated depressions that is less than the height distance of the remaining straight connecting edges.

* * * * *